US011332170B2

(12) United States Patent
Prill et al.

(10) Patent No.: US 11,332,170 B2
(45) Date of Patent: May 17, 2022

(54) TRIGGERING MONITORING DEVICE FOR A DEFORMATION TUBE FOR A COUPLING; AND TRAIN COUPLING

(71) Applicant: Voith Patent GmbH, Heidenheim (DE)

(72) Inventors: Thomas Prill, Gehrden (DE); Michael Ahrens, Braunschweig (DE); Matthias Homann, Braunschweig (DE); Bernd Lauter, Sontheim an der Brenz (DE); Tobias Seeberger, Dinkelsbühl (DE)

(73) Assignee: Voith Patent GmbH, Heidenheim (DE)

( * ) Notice: Subject to any disclaimer, the term of this patent is extended or adjusted under 35 U.S.C. 154(b) by 742 days.

(21) Appl. No.: 16/126,694

(22) Filed: Sep. 10, 2018

(65) Prior Publication Data

US 2019/0023290 A1 Jan. 24, 2019

Related U.S. Application Data

(63) Continuation of application No. PCT/EP2017/053618, filed on Feb. 17, 2017.

(30) Foreign Application Priority Data

Mar. 10, 2016 (DE) ..... 10 2016 203 921.0

(51) Int. Cl.
*B61G 9/20* (2006.01)
*B61G 11/16* (2006.01)

(52) U.S. Cl.
CPC ..... *B61G 9/20* (2013.01); *B61G 11/16* (2013.01)

(58) Field of Classification Search
CPC ..... B61G 9/20; B61G 11/16
See application file for complete search history.

(56) References Cited

U.S. PATENT DOCUMENTS 9,539,971 B2 1/2017 Ikeda et al.
2013/0126458 A1 5/2013 Ewerding
(Continued)

FOREIGN PATENT DOCUMENTS

CN 201484434 U * 5/2010
DE 1 279 709 10/1968
(Continued)

OTHER PUBLICATIONS

Notice of Transmission of the International Research Report and the Written Notice Issued the International Searching Authority or Declaration dated Jun. 6, 2017 for International Application No. PCT/EP2017/053618 (12 pages).
(Continued)

*Primary Examiner* — Peter J Macchiarolo
*Assistant Examiner* — Anthony W Megna Fuentes
(74) *Attorney, Agent, or Firm* — Taylor IP, P.C.

(57) ABSTRACT

The current invention relates to a triggering monitoring device for a deformation tube having two tube parts which can slide into each other against resistance in a coupling, in particular a train coupling, having a housing that includes a connection for connecting to the deformation tube and at least one working surface for action of one tube part during its movement relative to the other tube part of the deformation tube part, wherein the housing can be deformed through the action of the tube part on the working surface. The triggering monitoring device according to the invention is characterized in that a sensor is provided in or on the housing which detects deformation of the housing and which is moreover equipped to transmit detection of a deformation to an evaluation device.

9 Claims, 11 Drawing Sheets

(56) References Cited

U.S. PATENT DOCUMENTS

| | | | | |
|---|---|---|---|---|
| 2014/0041011 | A1* | 2/2014 | Beyer | B61L 15/0072 726/10 |
| 2015/0069002 | A1 | 3/2015 | Stroud | |
| 2015/0069003 | A1 | 3/2015 | Watts et al. | |
| 2017/0197641 | A1 | 7/2017 | Grahn et al. | |

FOREIGN PATENT DOCUMENTS

| | | | |
|---|---|---|---|
| DE | 1 947 819 | | 3/1971 |
| DE | 36 10 567 | A1 | 10/1987 |
| DE | 20 2005 004 502 | U1 | 6/2005 |
| DE | 10 2011 006 621 | A1 | 10/2012 |
| EP | 2 072 370 | A1 | 6/2009 |
| EP | 2 687 416 | A1 | 1/2014 |

OTHER PUBLICATIONS

German Research Report dated Feb. 21, 2017 for German Application No. 10 2016 203 921.0 (7 pages).

* cited by examiner

Fig.19
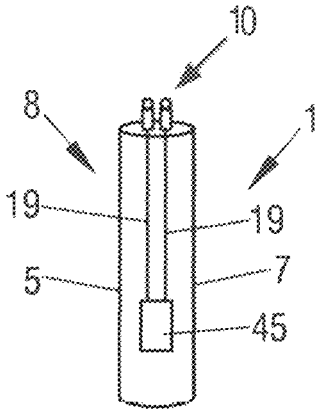
Fig.20
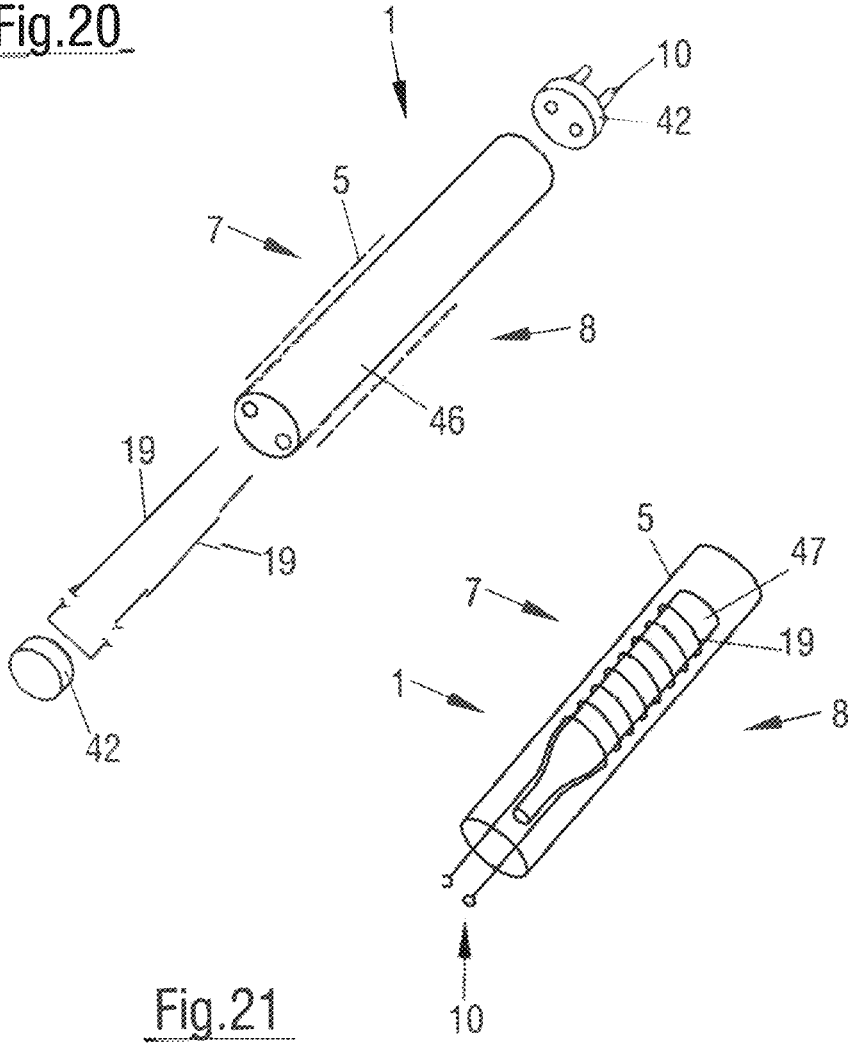
Fig.21

TRIGGERING MONITORING DEVICE FOR A DEFORMATION TUBE FOR A COUPLING; AND TRAIN COUPLING

CROSS REFERENCE TO RELATED APPLICATIONS

This is a continuation of PCT application No. PCT/EP2017/053618, entitled "TRIGGERING MONITORING DEVICE FOR A DEFORMATION TUBE FOR A COUPLING; AND TRAIN COUPLING", filed Feb. 17, 2018, which is incorporated herein by reference.

BACKGROUND OF THE INVENTION

1. Field of the Invention

The current invention relates to a triggering monitoring device for a deformation tube used with a train coupling.

2. Description of the Related Art

Couplings, in particular, train couplings according to the generic term include shock protection which protects the vehicle components that are coupled together by the coupling, as well as protecting the passengers or the transported goods from damage during excessive impact speeds. There are two options of absorbing the force, namely destructive and regenerative. Deformation tubes are used for destructive force absorption which include two tube parts which can be pushed into each other against resistance, in particular, with one tube part having a comparably smaller diameter which can be pushed into the tube part having the comparably larger diameter; wherein during the insertion process the larger tube part expands and deforms and/or the smaller tube part is compressed and thus deforms. During this deformation, relatively high energy is absorbed, which is desirable. However, operational conditions can occur that lead to not immediately recognizable initial damage of the deformation tube, for example if momentary insertion of the one tube part into the other tube part occurred without being immediately recognized, such prior damage reduces the subsequent energy absorption capacity of the deformation tube, so that the initially damaged deformation tube has to be replaced.

In practice, monitoring of the deformation tubes occurred conventionally by way of visual inspection and/or a sound test. The deformation tube that is to be monitored must be freely accessible for this purpose. The incrementally progressing integration of the deformation tube into the coupling, or respectively into the carriage parts that are to be coupled however results in that not all regions that are to be monitored being freely accessible, thus making monitoring complex.

To simplify monitoring, mechanical indicators in the embodiment of pins are currently used. These are inserted near the interface between the two tube parts into the tube part having the comparatively smaller outside diameter in such a way that when the two tube parts are pushed into each other the tube part having the comparatively larger diameter bends the pin protruding from the other tube part and thus, regardless of subsequent return of the two tube parts into the starting position, clearly indicate that deformation has occurred. However, this pin solution still requires visual inspection of the section of the deformation tube into which the pin is inserted.

SUMMARY OF THE INVENTION

The present invention provides a triggering monitoring device for a deformation tube with timely and reliable detection and indication of prior damage of the deformation tube in order to avoid possible consequential damage and downtime of the entire system associated therewith by implementing non-scheduled maintenance measures. The triggering monitoring device is additionally a compact and cost effective design and should ideally be mountable on the deformation tube.

Based on the solutions according to the invention, easy accessibility of the components of a deformation tube that are to be monitored is no longer necessary. In addition, an on-board diagnosis can provide the vehicle system the ability of early diagnosis and to simplify maintenance. In the embodiment of an on-board diagnosis, an automatic inquiry is made by the vehicle system to the triggering monitoring device or to an evaluation unit connected with same.

Installation of the triggering monitoring device occurs ideally near the interface of the two tube parts of the deformation tube that can slide into each other. Assembly can occur outside or inside on the deformation tube.

In one embodiment, the triggering monitoring device for a deformation tube which includes two tube parts that can slide into each other against a resistance, in a coupling, more particularly a train coupling, includes a housing with a connection for connecting to the deformation tube and at least one working surface for action of one tube part during its movement relative to the other tube part of the deformation tube. The housing of the triggering monitoring device can be deformed through the action of the tube part on the working surface, additionally a sensor is provided in or on the housing, the sensor detects deformation of the housing and which is equipped to transmit detection of a deformation to an evaluation device.

It is especially advantageous that the housing of the triggering monitoring device is equipped with an electrical connection that is at least indirectly connected with the sensor in order to connect an evaluation device.

The evaluation device can be located in or on the housing, or remotely. If positioned in or on the housing or remotely, an at least one electric line, in particular a multitude of electric lines, can be provided for connection of the evaluation device with the sensor. Generally, a wireless communication between the evaluation device and the sensor are also considered. At least one transmitter, in particular a receiver and a sensor, for example integrated into one component, can be provided in or on the housing, but also remotely from same which is connected with the sensor directly or at least indirectly via an interposed control unit. The evaluation device can communicate with a vehicle system, either wired or wireless. The sensor can alternatively be connected directly with the vehicle system. Several triggering monitoring devices or respectively their sensors can be connected with a common evaluation device and/or several evaluation devices can be connected with the vehicle system to accordingly retrieve information from several triggering monitoring devices.

The evaluation device is equipped for evaluation of deformation data that is detected by the sensor.

The housing is advantageously bent or sheared off, in particular through the action of the one tube part, in particular the outside tube part with the comparatively larger diameter, thus enabling detection of a deformation.

In an embodiment of the triggering monitoring device installed on an inside surface or respectively inside the deformation tube, the inner tube part that has a comparatively smaller outside diameter can also act on the working surface.

According to another embodiment, the housing of the triggering monitoring device includes at least one stationary housing part and at least one movable housing part that is moveable and/or twistable relative to the stationary housing part; and the at least one working surface is positioned on the movable housing part in such a manner that said housing part by an action of the tube part on the working surface is moved relative to the stationary housing part, wherein the sensor detects said movement.

According to another embodiment, the mobile housing part is supported rotatably by the stationary housing part and represents the shape of a cam, in particular one comparable with a cam on a cam shaft. Thus, the tube part acting upon the working surface can twist the cam-like housing part on the stationary housing part, wherein the stationary housing part advantageously at least essentially has a cylindrical shape that is surrounded by the movable housing part or which is positioned coaxially relative to the movable housing part via a rotary axis of the movable housing part.

For simple and secure connection of the triggering monitoring device, the stationary housing part advantageously has an outside thread on one axial end or is equipped with a through-bore progressing in the direction of the rotary axis of the movable housing part to form the connection.

According to one embodiment of the invention, the housing of the triggering monitoring device has at least one cylindrical end section, or is designed entirely in the form of a cylinder, and the connection to connect to the deformation tube is designed such that the cylindrical end section or one axial end of the cylinder that forms the housing is held in a bore of the deformation tube. The cylindrical end section or respectively the axial end of the cylinder can in particular be screwed radially from outside beside the tube part with the comparatively larger outside diameter into the tube part having the comparatively smaller outside diameter. Alternatively, screwing in from the inside into the tube part having the comparatively larger inside diameter is also possible.

For a screw attachment, an outside thread is accordingly provided on the cylindrical end section or on the axial end of the cylinder in order to form the connection for connecting the triggering monitoring device on the deformation tube.

According to another embodiment, the sensor has a deformation element that is irreversibly deformed if a deformation of the housing occurs. In the event of a deformation of the housing, the deformation element is for example broken off, sheared off and/or torn.

The sensor can include an electrical conductor that progresses over the deformation element in such a way that its electric conductivity or accordingly its electric resistance is changed in the event of a deformation of the deformation element. This change can then be detected by the sensor and a corresponding signal or corresponding data can be transmitted to the evaluation device.

According to one embodiment of the invention, the sensor includes an optical sender and an optical receiver which are coupled with one another via an optical signal that is dependent on a deformation of the housing. The optical signal is altered by deformation of the housing, for example deflection of a light beam which is captured by the sensor. In this case too, a signal or data are accordingly transmitted to the evaluation device.

According to one embodiment of the invention the sensor is designed to produce a magnetic field that is dependent upon the deformation of the housing, and accordingly to detect changes in the magnetic field.

Another embodiment is the design of the sensor in such a way that said sensor, depending upon deformation of the housing, produces an electric capacity, i.e. capacitance, and detects changes in the capacity.

In another embodiment the sensor is designed to produce an electromagnetic oscillating circuit and to detect changes in the electromagnetic oscillating circuit which again, depend on the deformation of the housing.

According to another embodiment, the sensor includes a pressure sensor which detects a pressure that is dependent upon the deformation of the housing.

In another embodiment, a volatile medium is enclosed in the housing, in particular a fluid and that the working surface is positioned on the housing in such a way that an action of the tube part on the working surface opens the housing, thus releasing the medium, wherein the sensor is designed to detect at least indirectly the presence and/or the volume of the medium present in the housing. For example, an electroconductive fluid is enclosed in the housing and the sensor includes at least one or at least two electrodes that is/are in electrical contact with the fluid; and the sensor is designed so that it detects an electrical current and/or an electrical resistance that is dependent upon the presence and/or the volume of the fluid in the housing.

With the various embodiments of the sensor, changes of at least one physical dimensions are thus accordingly detected, the value of which is dependent upon the status of deformation of the housing. Based on the changes of the at least one physical dimension detected by the sensor, wherein the sensor accordingly generates data or signals, it can be determined by an evaluation device whether a deformation or an inadmissible deformation of the housing and thus inadmissible movement of the two tube parts into each other has occurred. The signal or the data are stored, and/or the physical dimension is irreversibly changed in such a way that even a reverse deformation of the housing or respectively a reverse movement of the tube parts into their starting position have no effect or no decisive influence thereupon.

An another embodiment provides that an electric switch or push button is provided in the housing and is positioned such that it is activated in the event of a deformation of the housing. For example, based on the positioning of the switch in the connected electrical circuit, detection is generally possible of whether a movement of the tube parts has occurred. The switch is notably designed that after its single actuation it remains in the position that deviates from the starting position, the operating position, regardless of whether it opens a previously closed electric circuit or closes a previously open electric circuit.

In an embodiment with a pushbutton in a relevant electric circuit, a status indicator, in particular a flag can be used which advantageously continuously indicates that a deformation has occurred. Based on this, a warning signal can for example be generated or simply a warning light can be turned on, advantageously continuously until manually turned off, which can be located near the relevant deformation tube or also remotely from same.

In one embodiment an electric circuit that is closed prior to deformation of the housing, or respectively an electrical conductor of the sensor is interrupted as a result of the deformation of the housing and in another arrangement an electric circuit that is interrupted prior to deformation of the housing, or respectively an electrical conductor of the sensor is closed as a result of the deformation of the housing, in each case being recorded by the evaluation device.

According to one embodiment of the invention, an electrical conductor is applied on a deformation element, in particular vapor deposited, or respectively the deformation element is coated with an electrical conductor and the deformation element is designed to be destroyed in the event of a deformation of the housing of the triggering monitoring device. The deformation element consists for example of glass or another brittle material and/or includes predetermined breaking points at which destruction occurs or begins.

One embodiment of the invention with a deformable or respectively destructible deformation element, wherein the deformation element can also be formed by the housing or can be provided inside the housing, includes two electrodes as well as a contact element, wherein the electrodes as well as the contact element are electrically conductive and wherein the contact element is positioned against the electrodes such that an electric current can flow from the one electrode via the contact element to the other electrode. The contact element is pressed against the two electrodes with an elastic pressure element. Instead of only one single contact element and/or only one single elastic pressure element, a multitude of appropriate elements may also be provided. The deformation element acts as an abutment for the elastic pressure element in such a way that in the event of a deformation or destruction of the deformation element said abutment drops off or respectively is destroyed, so that the elastic pressure element no longer presses the contact element against the electrodes, so that the electric connection of the two electrodes with one another is interrupted.

According to one embodiment of the invention a sensor can be used which, conventionally is utilized for other tasks, for example for temperature measurements, for example a platinum sensor (Pt-sensor). Use of a heating cartridge is also conceivable. Respective components namely have electrical winding or differently designed conductors, whose electrical resistance is at least changed in the event of a deformation of the component. The electrical conductor can moreover be interrupted during such a deformation, depending on the location of the sensor in or on the housing. The respective change of the electrical resistance or the interruption of the electric conductivity may be used to detect the deformation and can be measured at an electric connection of the component.

In another embodiment, an at least one strain gauge is provided as a sensor on the housing, in order to detect a respective deformation of the housing.

According to one embodiment of the invention, a short in an electrical connection in the sensor is caused by the deformation of the housing of the triggering monitoring device. The sensor detects for example electrical conductors that make contact with each other because of the deformation of the housing. It is also conceivable to provide a winding of an electrical conductor wherein individual coils contact each other in the event of the deformation of the housing, whereby the electrical resistance in the winding is again changed, which can be captured especially directly or indirectly, via the electrical connection. The latter for example via an induction change or the change in a magnetic field.

At least one film can be used in the sensor that begins to tear, or tears through in the event of a deformation of the housing, thereby changing at least one electrical parameter, in particular its electrical resistance.

In one embodiment of the invention at least one conductor is accommodated in a non-conducting, in particular a tubular, component and the electrical conductor is interrupted through the deformation of the tubular component or is changed in its shape to such an extent that its electrical resistance changes. The tubular component consists in particular of a brittle material and/or has at least a predetermined breaking point. Accordingly, an electrical conductor can be applied to a non-conducting brittle material that breaks during a deformation of the housing and causes at least a change in resistance in the conductor or the interruption of the conductor. Finally, it is conceivable to provide a filling material in the housing of the triggering monitoring device, consisting of insulating ceramics or another insulating brittle material, for example glass or a ceramic casting compound whereby an electrically conducting material is inserted into the filling material and shearing and/or bending of the housing with the filling material disconnects an electrical connection to the or of the inserted electrically conducting material.

In another embodiment the housing is produced from an insulating brittle material. A filler is the electrically conducting material. In the event of the housing breaking, the electrical connection which is provided via the filler, is interrupted or changed.

It is advantageous if the triggering monitoring device, based on the deformation of the housing not only provides the data that is to be automatically captured in a dependent reaction, in other words a deformation of the housing, but in addition provides an optical signal that a deformation has occurred, so that the evaluation is additionally possible based on visual inspection.

In another embodiment installation of the triggering monitoring device in or on the deformation tube can occur by any suitable method, for example through positive interlocking or bonded connection such as pressing, gluing, bolting or soldering/welding.

An inventive deformation tube for a coupling, in particular for a train coupling has two tube parts which can slide into each other against resistance and a triggering monitoring device in the region of an interface between the two tube parts, whereby the triggering monitoring device is connected to the deformation tube.

In another embodiment, a deformation tube is especially in the embodiment of a Scharfenberg coupling, wherein during coupling two couplings advantageously engage in a rigid connection, via which tensile and compression forces are transferable. The deformation tube is positioned in particular between a coupling head with a disconnect device and a train protection/shock absorbing device which can be installed on the carriage.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein:

FIG. 18-22 show additional embodiments of the invention; and

Corresponding reference characters indicate corresponding parts throughout the several views. The exemplifications set out herein illustrate embodiments of the invention and such exemplifications are not to be construed as limiting the scope of the invention in any manner.

DETAILED DESCRIPTION OF THE INVENTION

Figure 1:
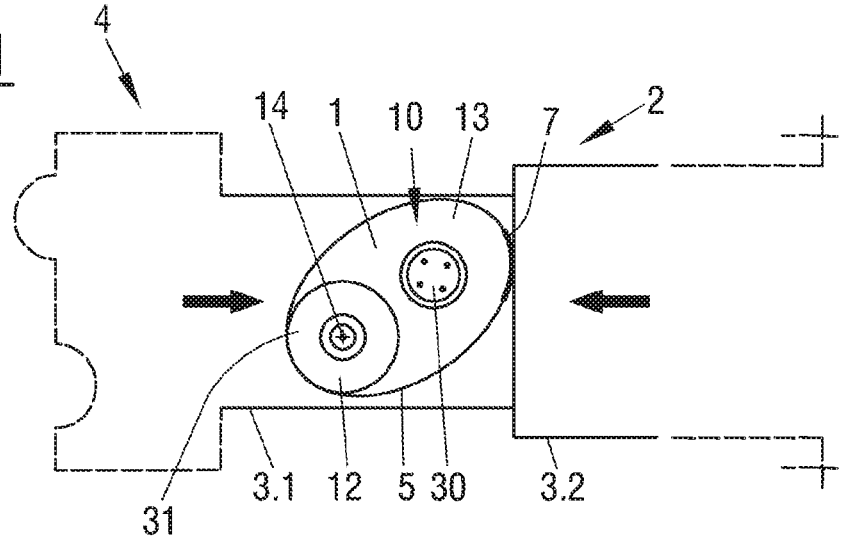
FIG. 1 shows a triggering monitoring device with eccentric cams.

Referring to the drawings and more particularly to FIG. 1, there is shown a schematic illustration of a triggering monitoring device 1 which is arranged on a first tube part 3.1 of a deformation tube 2 of a coupling 4, for example according to a Scharfenberg design (Schaku). The Schaku is indicated only schematically with broken lines. First tube part 3.1 has a smaller outside diameter than the also provided second tube part 3.2 and in the event of deformation of at least the second tube part 3.2 can be pushed into same due to outside pressure force that is indicated by the two arrows Triggering monitoring device 1 includes a housing 5, including a stationary housing part 12 which is mounted on first tube part 3.1 and a mobile housing part 13 which is mounted rotatably on stationary housing part 12 in this case above rotational axis 14 that is positioned vertically on first tube part 3.1. In order to better understand the structure of triggering monitoring device 1 we refer you to FIG. 3 where respective components are marked with respective identification.

Movable housing part 13 has a working surface 7 with which a front surface of second tube part 3.2 acts when first tube part 3.1 is pushed into second tube part 3.2 due to an external force.

Due to the action of second tube part 3.2 on working surface 7 and continued insertion of first tube parts 3.1 into second tube part 3.2, movable housing part 13 is twisted on the outer surface of stationary housing part 12 which, in this case is cylindrical in shape, because stationary housing part 12 is connected rigidly at its connection 6 to first tube part 3.1. In the illustrated design example, connection 6 is provided by a through-bore 16 in combination with a screw which is not illustrated in detail and which is screwed through through-bore 16 into first tube part 3.1. Other connection methods are conceivable.

Figure 2:
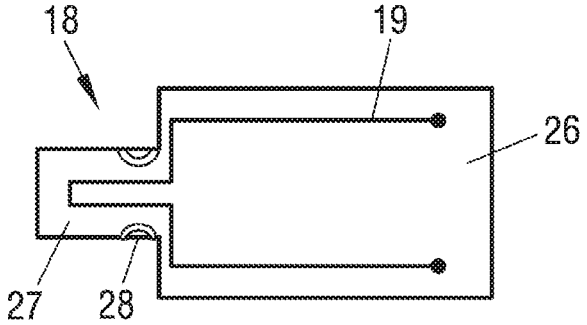
FIG. 2 shows a board that has a predetermined breaking point.
Figure 3:
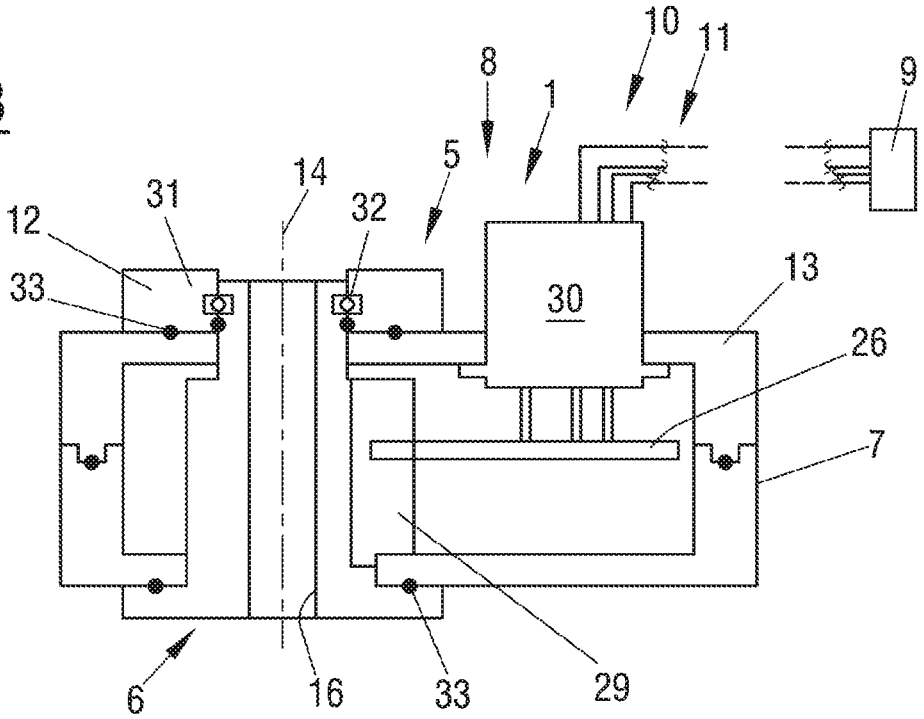
FIG. 3 shows a triggering mounting device with a plate.

A sensor 8 is provided in housing 5 as illustrated in FIG. 3. A board 26 is provided in one of the two housing parts 12, 13; in this case in movable housing part 13 which has a break-off tab 27 as illustrated in FIG. 2. Break-off tab 27 notably has a predetermined breaking point 28; however, this not absolutely necessary. An electrical conductor 19 is provided on board 26, in this case in the embodiment of a strip conductor, which extends over the break-off location of break-off tab 27. Break-off tab 27 thus represents a deformation element 18 over which electrical conductor 19 proceeds.

Break-off tab 27 protrudes from one housing part, in this instance movable housing part 13, into the other housing part, in this instance the stationary housing part 12, where it is held in place, in this case by a spacer 29. Since, at the same time board 26 is fixed on the other housing part which in this case is movable housing part 13, a relative movement between the two housing parts 12, 13 which in this case is twisting of movable housing part 13 on stationary housing part 12 leads to breaking off of break-off tab 27 from the rest of board 26 and thus to severing of electrical conductor 19.

Since electrical conductor 19 is connected with electric connector 30 which provides an electrical connection 10 for an evaluation device 9, the interruption of electrical conductor 19 due to the change in the electric resistance or respectively the electric conductivity can be captured and based thereupon can be closed upon twisting of movable housing part 13 relative to stationary housing part 12 due to the insertion of first tube part 3.1 into second tube part 3.2.

Evaluation device 9 is connected in housing 5 via electric lines 11 at electrical connection 10 of sensor 8 and is located in particular remotely from housing 5. However, this is not absolutely necessary.

By breaking off break-off tab 27 from board 26, electrical conductor 29 is permanently interrupted, so that a conceivable premature damage of deformation tube 2 can be reliably detected, independent of its return into its starting position.

Stationary housing part 12 may be designed cylindrically, in particular symmetrically over movable housing part 13 and can include an outside surface for a bore of movable housing part 13. In the illustrated design example, movable housing part 13 is placed axially on stationary housing part 12 and is secured by a clamping ring 31 which in this case is held, for example by a retainer ring 32 on stationary housing part 12. Movable housing part 13 is sealed relative to stationary housing part 12, or respectively clamping ring 31. See for example, illustrated seals 33.

As a result of clamping ring 31 being locked above rotary axis 14 onto stationary housing part 12, additional screws are no longer necessary for assembly.

Figure 4:
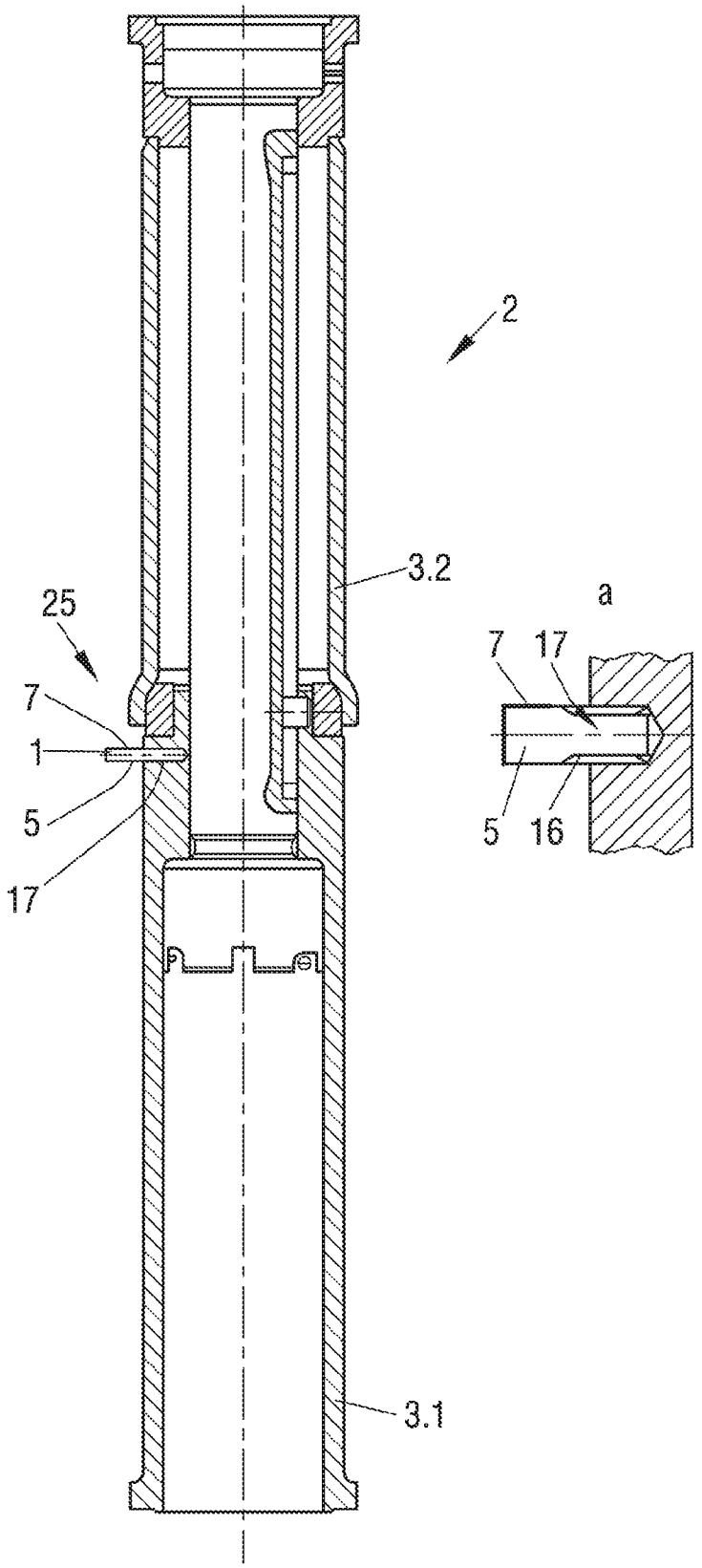
FIG. 4 shows a deformation tube with an installed triggering monitoring device.

FIG. 4 schematically illustrates a deformation tube 2 into which a cylindrical triggering monitoring device 1 is screwed from the outside into first tube part 3.1 with comparatively small outside diameter. Cylindrical housing 5 of triggering monitoring device 1 is deformed during insertion of first tube part 3.1 into second tube part 3.2, wherein this deformation is detected by a sensor that is not shown in detail in FIG. 4. The sensor designs are however not limited to cylindrical housings 5 of triggering monitoring device 1 but can also be used with other designs of triggering monitoring devices 1.

Referring now to FIGS. 5-11 and 13, the advantage of such a cylindrical design of housing 5 is that triggering monitoring device 1 can be inserted into deformation tube 2 instead of the previous pins. Housing 5 is for example pressed into a bore 17 in tube component 3.2. As schematically illustrated in detail in FIG. 4, an outside thread 15 may also be provided on an axial end of housing 5, that is screwed into bore 17 which accordingly is equipped with an inside thread.

Bore 17 is designed as a blind bore which presents a feasible option in any embodiment.

In FIG. 1 and in FIG. 4 a triggering monitoring device 1 is located in the region of interface 25 of the two tube parts 3.1, 3.2 so that even a small relative displacement of tube parts 3.1, 3.2 leads to a response of triggering monitoring device 1.

Figure 5:
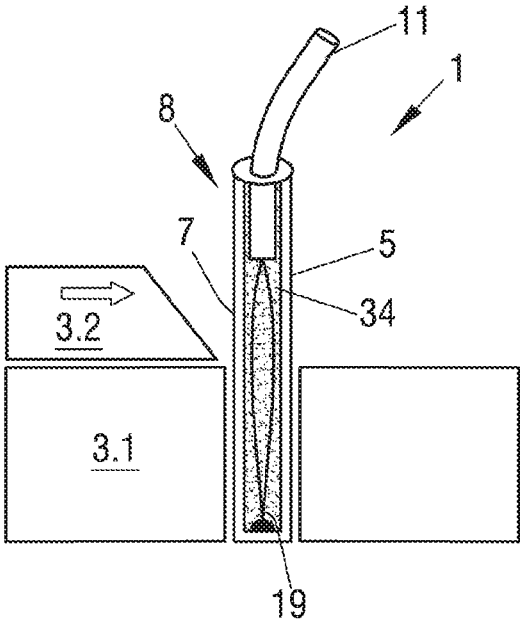
FIG. 5-11 show various cylindrical triggering monitoring devise with sensors that capture various physical dimensions.

According to FIG. 5, an electrical conductor 19, in this case a loop conductor is again provided in housing 5 to represent sensor 8. Electrical conductor 19 is embedded for example in a casting compound 34 in housing 5. During deformation of housing 5, electrical conductor 19 is severed or at least changes its resistance due to the deformation. This can again be detected by an evaluation device that is not shown in further detail and which is advantageously connected via electrical line 11.

Figure 6:
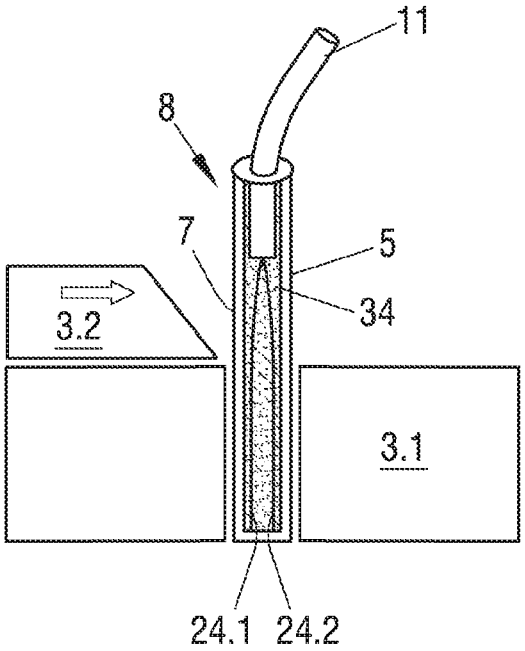

According to FIG. 6, two electrodes 24.1, 24.2 in housing 5 produce an electric capacity in sensor 8. Electrodes 24.1, 24.2 are for example also embedded in a casting compound 34. Due to a deformation of housing 5, the electrical capacity of sensor 8 changes, which again can be detected by an evaluation device (not illustrated) which in particular is connected via electric line 11. For example, the distance of the two electrodes 24.1, 24.2 is changed by squeezing or bending of housing 5, or in the event of shearing off of housing 5 the active surface of electrodes 24.1, 24.2 is decreased so that the capacity changes.

Figure 7:
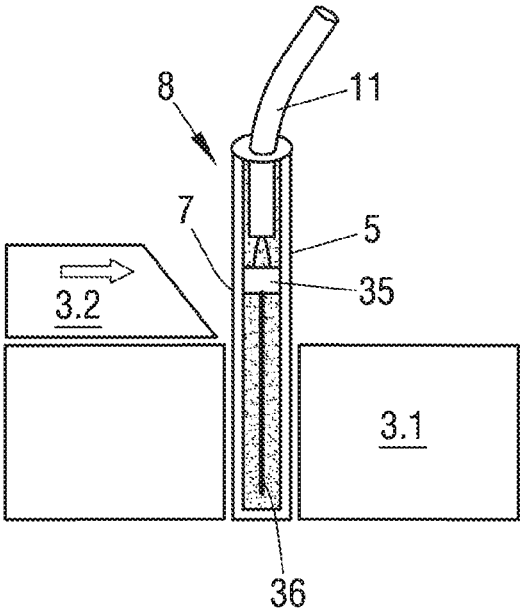

In FIG. 7 a sensor is provided that produces an inductivity and captures a change in inductivity that occurs as a consequence of the deformation of housing 5. Sensor 8 includes an electric coil 35 and a ferromagnetic rod 36. Coil 35 and/or ferromagnetic rod 36 can for example, again be embedded in a casting compound. Due to deformation or bending or respectively breaking off of ferromagnetic rod 36 the magnetic field and thus the inductivity of sensor 8 is changed which is again detected via electric line 11. Accordingly, the at least one ferromagnetic rod extends advantageously over the bending point or shear-off point of housing 5 and thus over working surface 7.

Figure 8:
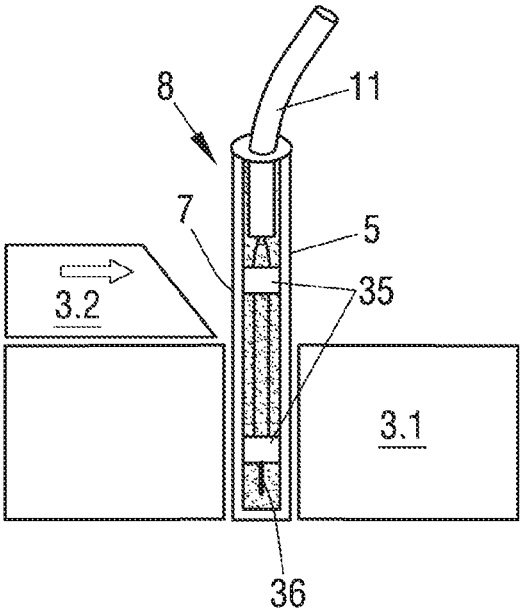

FIG. 8 is extensively consistent with that illustrated in FIG. 7, however an electric coil 35 is mounted on ferromagnetic rod 36 above and below the bending point or respectively the shear-off region of housing 5, in other words working surface 7 of tube part 3.2, so that when housing 5 bends or shears off due to insertion of first tube part 3.1 into second tube part 3.2 the magnetic flow and thus the coupling property of the two coils 35 to one another is changed. This is captured via electric line 11 by an accordingly connected evaluation device which is not illustrated.

Figure 9:
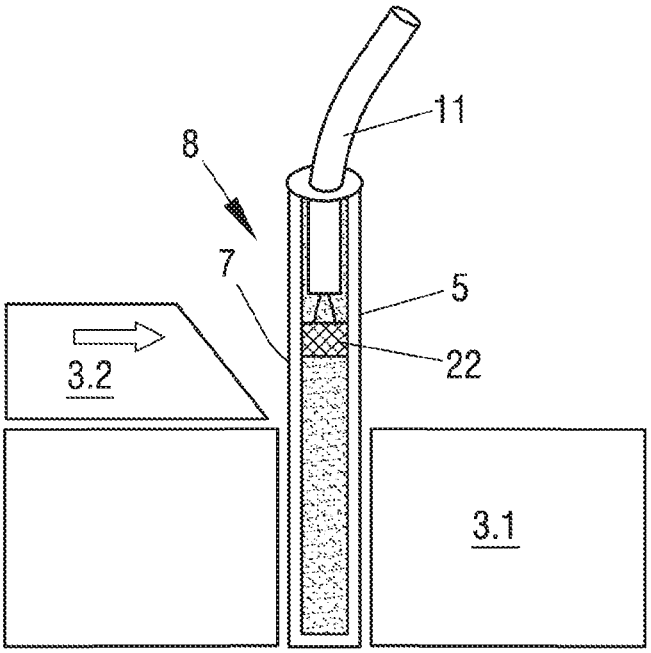

In FIG. 9, sensor 8 is deformed in such a way during deformation or shearing off of housing 5 that a pressure change occurs in sensor 8. The pressure change is monitored by a suitable measuring device, in this case for example by illustrated pressure sensor 22.

Figure 10:
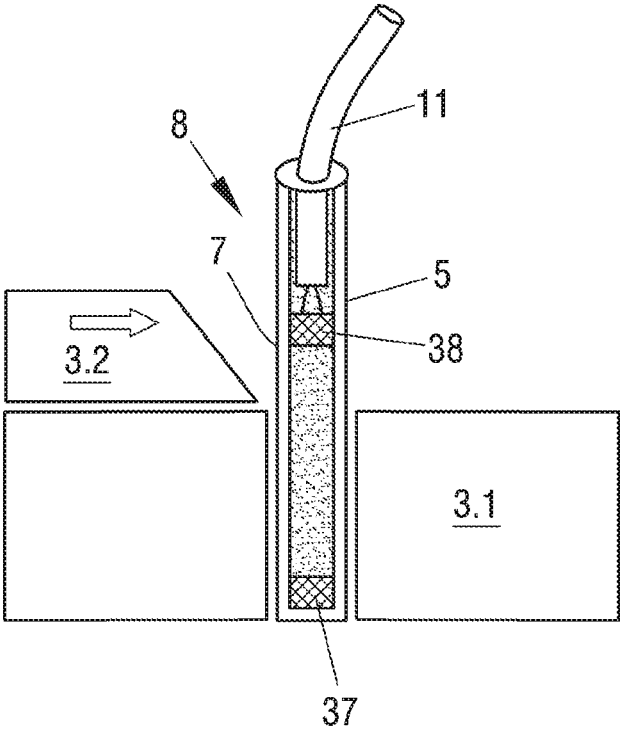

In FIG. 10, sensor 8 produces a magnetic field which changes as a consequence of the deformation of housing 5. For this purpose, a magnet 37 is located in housing 5, opposite of which a magnetic sensor 38 is located on the other side of the breaking point or respectively shear-off point of housing 5, in particular on the other side of working surface 7. During or after deformation or shearing off of housing 5, magnetic sensor 38 no longer measures the same magnetic field as in the non-deformed or respectively non-sheared off condition of housing 5. This can again be captured by an evaluation device 9 (not illustrated).

Figure 11:
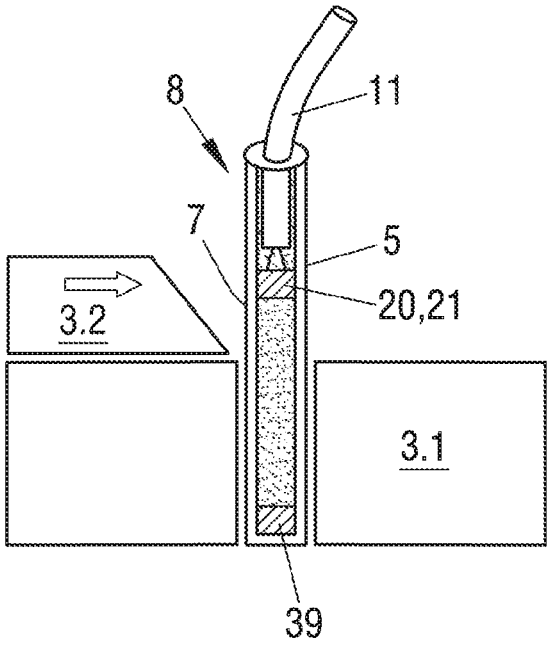

In FIG. 11, sensor 8 has an optical sender 20 and an optical receiver 21 which in this case are integral. On the other side of the shear-off point or respectively the bending point of housing 5 (on the other side of working surface 7) an optical reflector 39, with or without an optical filter is provided. During or after deformation or shearing off of housing, sensor 8 is deformed in such a way that optical receiver 21 no longer captures the same reflections of reflector 39 as in the non-deformed or respectively non-sheared off condition of housing 5. The change in reflection is suitably monitored, in particular by an evaluation device which again, is not illustrated. Instead of reflector 39, optical sender 20 or optical receiver 21 could also be positioned in such a way that the sender and the receiver are located on opposite sides of the shear-off point or bending point of housing 5.

Figure 12:
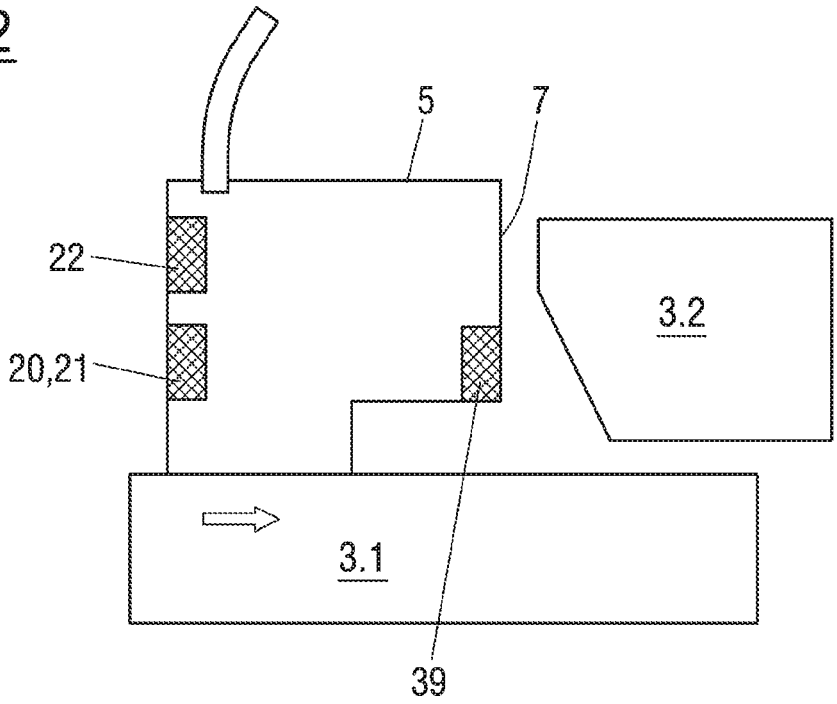
FIG. 12 shows a triggering monitoring device with a crash-box representing the housing.

In FIG. 12, housing 5 is in the embodiment of a crash box. The crash box will be deformed by pushing together of tube parts 3.1 and 3.2. Sensor 8 arranged in housing 5 includes a pressure sensor 22 as well as an optical sensor with optical sender 20 and optical receiver 21 or respectively with optical sender 20 and receiver 21 opposite an optical reflector 39. This ensures even more reliable detection of a deformation of housing 5, due to the redundant measurement. Insertion of tube part 3.1 into tube part 3.2 does not function predominantly according to shearing or bending of housing 5, but the housing is first compressed. Both types of deformation are interchangeable or can be combined with one another in the herein illustrated design examples.

Figure 13:
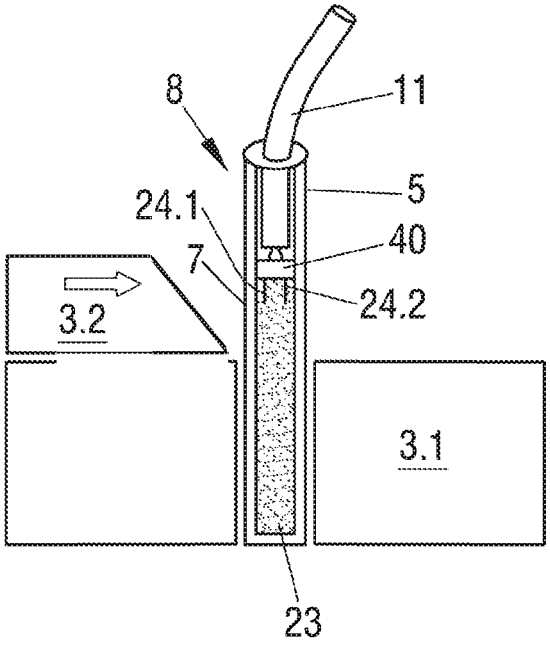
FIG. 13 shows a triggering monitoring device with an electrically conducting fluid inside the housing.

In FIG. 13, a volatile medium 23, in this case a liquid is arranged in housing 5 to form sensor 8. Volatile medium 23 is electrically conductive. Two electrodes 24.1, 24.2 are submerged into volatile medium 23, in this case into the liquid in such a way that they are connected with one another via volatile medium 23. In order to prevent volatile medium 23 from escaping from housing 5 in its deformed condition, said housing is accordingly sealed, in this case for example by an inserted stopper 40. If first tube part 3.1 is moved relative to second tube part 3.2, housing 5 is damaged and as a result its interior space is opened, so that volatile medium 23 leaks out. The electrical connection between the two electrodes 24.1 and 24.2 is interrupted which again, can be detected via electrical line 11 by an evaluation device (not illustrated).

Figure 14:
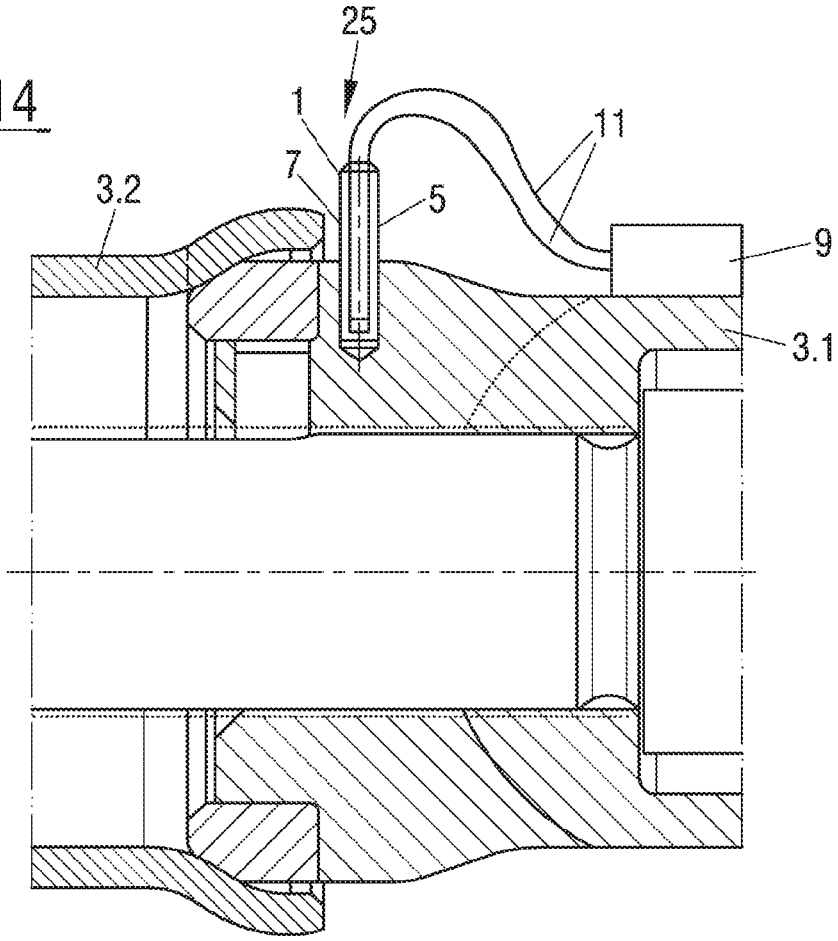
FIG. 14-16 show possible arrangements of evaluation equipment, central or decentralized.

FIG. 14 shows a cylindrical design of housing 5 of a triggering monitoring device 1 in the region of an interface 25 of two tube parts 3.1, 3.2 with an evaluation device 9 located near triggering monitoring device 1, wherein said evaluation device is connected to triggering monitoring device 1 via electrical line 11.

Figure 15:
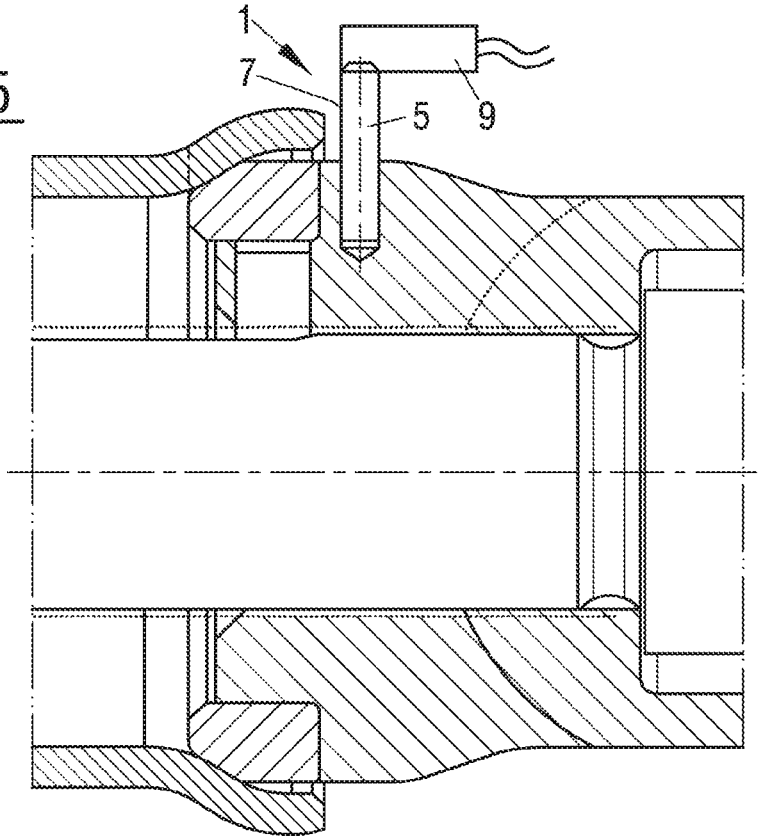
Figure 16:
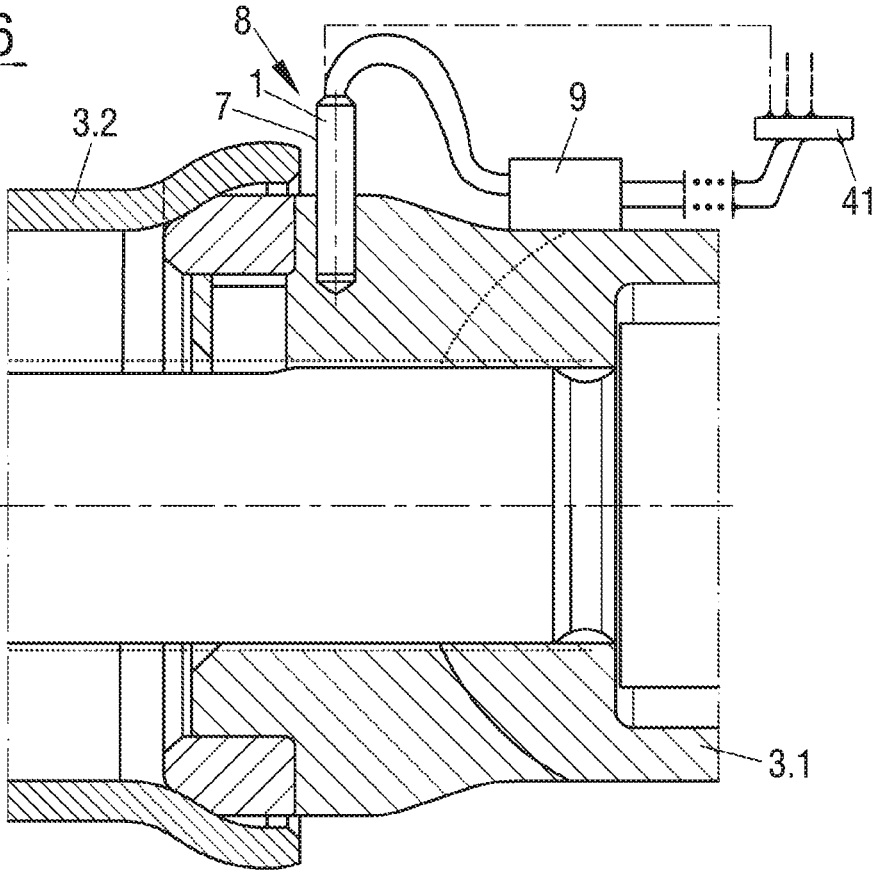

In FIG. 15, evaluation device 9 is connected to housing 5 and is supported by same. Where necessary it is possible with each of these designs to connect evaluation device 9 with an additional control unit, for example with a vehicle system 41, in particular in the embodiment of a vehicle master computer, as illustrated in FIG. 16. In addition, or alternatively, vehicle master computer 41 can also be connected directly with sensor 8 or respectively with triggering monitoring device 1, as indicated in FIG. 16 by the dash-dot line.

Especially with various couplings in a vehicle or also per each coupling and/or per each deformation tube in a vehicle, several triggering monitoring devices can be provided which are connected accordingly on a common evaluation device or respectively to an individual evaluation device. Here it is also possible to connect the various triggering monitoring devices with a vehicle system, in particular in the embodiment of a vehicle master computer, with or without interposed evaluation device. One evaluation device an also query several triggering monitoring devices.

Figure 17:
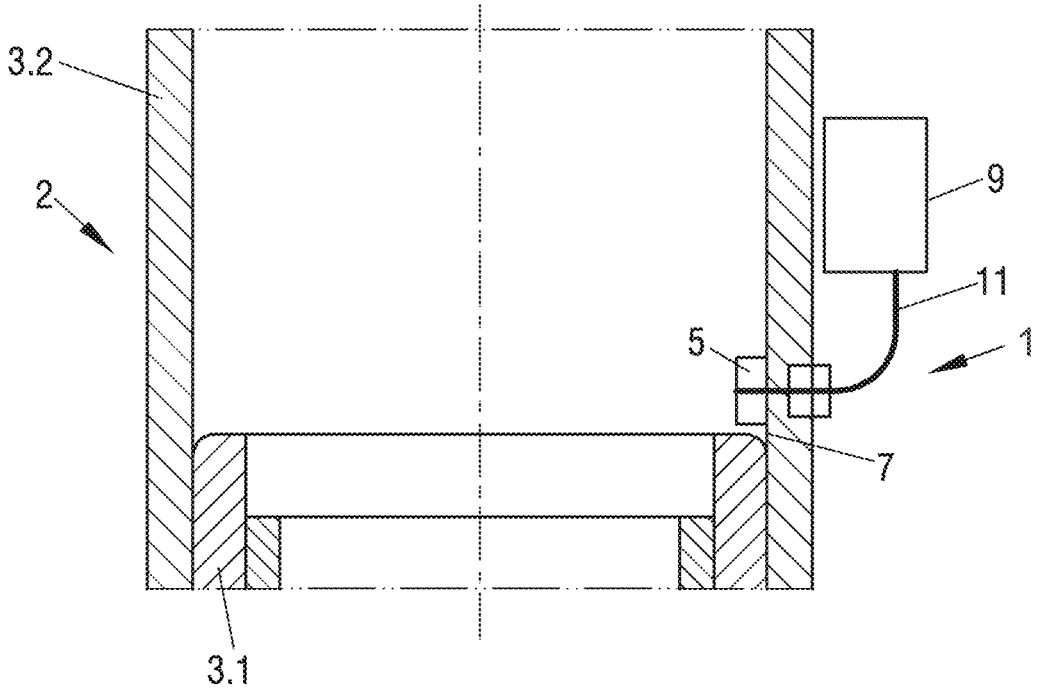
FIG. 17 shows a working surface of the housing positioned inside the deformation tube.

FIG. 17 illustrates a working surface 7 being located radially inside deformation tube 2. In this case, triggering monitoring device 1 is mounted in tube part 3.2 with the comparatively larger diameter. At least working surface 7 is located radially inside tube part 3.2 with comparatively larger diameter.

Figure 18:
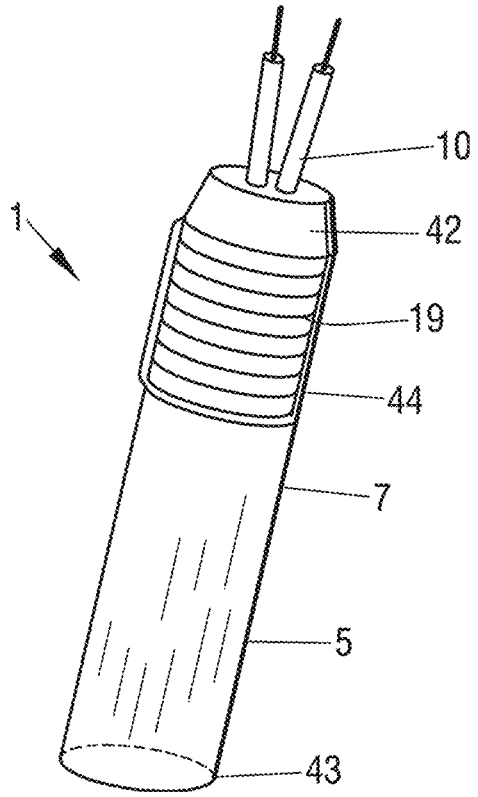

In FIG. 18, a conventional heating cartridge comprising an electrical conductor 19 inside a cylindrical housing 5 is used as triggering monitoring device 1. An electric connection 10 is provided for electrical conductor 19, for example in an end cap 42. A welded end cap or another suitable connection could also be provided at the opposite end of housing 5. In particular, a filling material is provided between housing 5 and electrical conductor 19, for example magnesium oxide which herein is identified with 44.

In FIG. 19, a conventional temperature sensor is used as triggering monitoring device 1, in particular with a Pt100 thin-film sensor or with another suitable electrically conductive measuring element 45. Measuring element 45 is connected at electric connection 10 via one or respectively two electrical conductors 19, so that when housing 5 bends or shears off, said conductor 19 is severed, thus causing a change in the electric resistance of sensor 8 or respectively in its electric connection.

In FIG. 20, an electrical conductor 19 is inserted into a tubular body 46, made particular of ceramics or another brittle material. Tubular body 46 is closed off by two end caps 42, one of which with the electric connection 10. The electric connection could also be provided at another location, for example at the other end of body 46, so that electrical conductor 19 would have to extend only linearly through the body. Tubular body 46 can herein itself represent housing 5 or as indicated by the dashed lines can once more be surrounded by a housing 5. In the event of a deformation or shearing off of housing 5, tubular body 5 breaks so that electrical conductor 19 is severed, which is detected via electric connection 10 due to the resistance change or respectively the change in the electric conductivity.

In FIG. 21, electrical conductor 19 is applied to a brittle support 47, in the embodiment of a coil or a spiral. The application can occur by winding, vapor deposition or by another coating.

In the event of deformation or shearing off of housing 5, brittle support 47 is destroyed and thus the capacity or the electric resistance of the electrical conductor 19 and thereby that of the sensor changed. This can be detected via electric connection 10.

Figure 22:
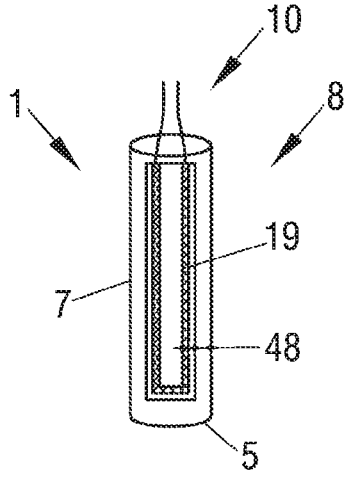

In FIG. 22, an electrical conductor 19 is vapor deposited onto an insulating sensor carrier 48, thus forming sensor 8. In the event of a deformation or destruction of housing 5, the shape of electrical conductor 19 on sensor carrier 48 is changed or interrupted which is again detected via electric connection 10. Carrier 48 can be plate-like or cylindrical. Other arrangements are possible.

Figure 23:
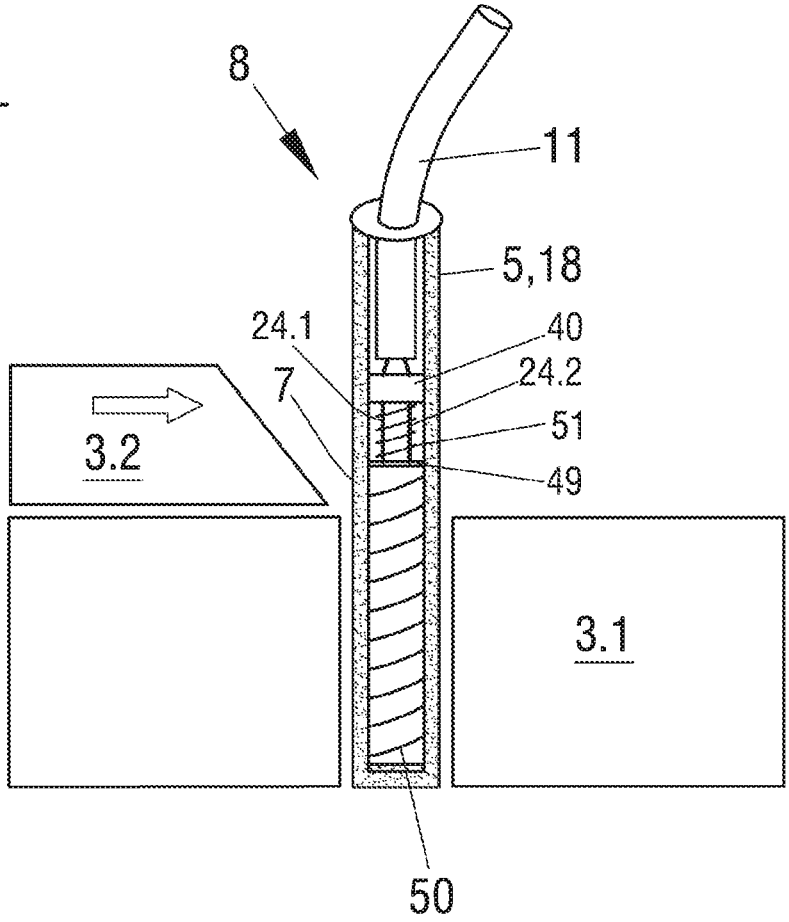
FIG. 23 shows a triggering monitoring device with two electrodes and one contact element.

In FIG. 23, a housing 5 made from a brittle material, for example glass or ceramics is provided, wherein housing 5 at the same time represents a deformation element 18 of sensor 8. Here too, deformation element 18 could be provided in addition to housing 5.

Sensor 8 includes two electrodes 24.1 and 24.2 which are electrically conductively connected with one another via a contact element 49. Contact element 49 is herein pressed by elastic pressure element 50 against the two electrodes 24.1, 24.2 in this case respectively against a front end of same. Contact element 49 in the illustrated design example is plate-like, but can also be something else.

Deformation element 18 forms an abutment for elastic pressure element 50; in this case on a side opposite contact element 49, for example through the bottom region of the housing-like, in this case cylindrical deformation element 18. If housing 5 or respectively deformation element 18 is deformed or destroyed through relative movement of the two housing parts, stationary housing part 12 and movable housing part 13, elastic pressure element 50 relaxes because the abutment drops off. As a result, contact element 49 is lifted off the two electrodes 24.1., 24.2 and the electrical connection between the two elements 24.1 and 24.2 is interrupted.

As illustrated, a second elastic pressure element 52 may be provided which, at a drop off of the abutment of the spring force of first elastic pressure element 50 actively pushes contact element 49 away from electrodes 24.1 and 24.2. However, other measures are also conceivable for this. For example, contact element 49 can be connected or fastened to elastic pressure element 50 in order to ensure reliable separation of the electrically conductive connection. It would also be possible for example, to provide a tension-proof connection between contact element 49 and the area of deformation element 18 which forms the abutment, and which is removed from electrodes 24.1, 24.2 in the event of destruction of deformation element 18.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

COMPONENT IDENTIFICATION LIST

1 triggering monitoring device
2 deformation tube
3,1, 3.2 tube parts
4 coupling
5 housing
6 connection
7 working surface
8 sensor
9 evaluation device
10 electrical connection
11 electric line
12 stationary housing part
13 movable housing part
13 rotary axis
15 outside thread
16 through bore
17 bore
18 deformation element
19 electrical conductor
20 optical sender
21 optical receiver
22 pressure sensor
23 volatile fluid
24.1, 24.2 electrodes
25 interface
26 board
27 break-off tab
28 predetermined breaking point
29 spacer
30 electric plug
31 clamping ring
32 retainer ring
33 seal
34 casting compound
35 electrical coil
36 ferromagnetic rod
37 magnet
38 magnet sensor

39 optical reflector
40 stopper
41 vehicle system
42 end cap
43 end plate
44 filler material
45 measuring element
46 tubular body
47 brittle support
48 sensor support
49 contact element
50 elastic pressure element
51 second elastic pressure element

What is claimed is:

1. A triggering monitoring device for a deformation tube used with a train coupling, comprising:

a first tube part and a second tube part sliding into each other against a resistance in the train coupling;

a housing including a connection for connecting to the deformation tube and at least one working surface for an action of the first tube part during movement of the first tube part relative to the second tube part of the deformation tube, the housing deforming through the action of the first tube part and the second tube part on the at least one working surface; and a sensor located in or on the housing for detecting a deformation of the housing and transmitting detection of the deformation to an evaluation device, wherein the sensor produces a magnetic field with the deformation of the housing and detects changes in the magnetic field.

2. The triggering monitoring device according to claim 1, wherein the housing is equipped with an electrical connection that is at least indirectly connected with the sensor to connect to the evaluation device.

3. The triggering monitoring device according to claim 2, wherein the evaluation device is positioned on or remotely from the housing and is connected with the sensor, by at least one electric line, for an analysis of sensor data.

4. The triggering monitoring device according to claim 1, wherein the housing is at least one of bent and sheared off through the action of the first tube part and the second tube part on the at least one working surface.

5. The triggering monitoring device according to claim 1, wherein the housing includes:

at least one stationary housing part and at least one movable housing part, wherein the at least one movable housing part is at least one of moveable and twistable relative to the at least one stationary housing part; and the at least one working surface is positioned on the at least one movable housing part, wherein the at least one movable housing part is moved relative to the at least one stationary housing part, by the action of the first tube part and the second tube part on the at least one working surface, wherein the sensor detects the at least one movable housing part being moved relative to the at least one stationary housing part.

6. The triggering monitoring device according to claim 1, wherein the housing includes at least one cylindrical end section, where the connection retains the at least one cylindrical end section in a bore of the deformation tube.

7. A triggering monitoring device for a deformation tube used with a train coupling, comprising:

a first tube part and a second tube part sliding into each other against a resistance in the train coupling;

a housing including a connection for connecting to the deformation tube and at least one working surface for an action of the first tube part during movement of the first tube part relative to the second tube part of the deformation tube, the housing deforming through the action of the first tube part and the second tube part on the at least one working surface; and a sensor located in or on the housing for detecting a deformation of the housing and transmitting detection of the deformation to an evaluation device, wherein the housing includes at least one cylindrical end section, where the connection retains the at least one cylindrical end section in a bore of the deformation tube, wherein the connection is provided by an outside thread on the at least one cylindrical end section of the housing.

8. A deformation tube for a train coupling, comprising: a first tube part and a second tube part sliding into each other against a resistance; and a sensor connecting to the deformation tube in a region of an interface between the first tube part and the second tube part and transmitting detection of a deformation of the deformation tube to an evaluation device, wherein the sensor produces a magnetic field due to the deformation and detects changes in the magnetic field.

9. The deformation tube according to claim 8, wherein the coupling includes a Scharfenberg train coupling.

* * * * *